United States Patent [19]

Smith

[11] 4,164,597

[45] Aug. 14, 1979

[54] METHOD OF MIXING AND SPRAYING CONCRETE ONTO PIPE

[75] Inventor: Carl K. Smith, Mathis, Tex.

[73] Assignee: Midcon Pipeline Equipment Co., Houston, Tex.

[21] Appl. No.: 846,699

[22] Filed: Oct. 31, 1977

Related U.S. Application Data

[63] Continuation of Ser. No. 709,189, Jul. 27, 1976, abandoned.

[51] Int. Cl.[2] ..... B05D 1/02

[52] U.S. Cl. ..... 427/425; 118/612; 118/126; 118/321; 118/DIG. 11; 366/66; 366/67; 366/186

[58] Field of Search ..... 427/201, 204, 421, 424, 427/425, 427; 118/DIG. 11, DIG. 16, 612, 320, 25, 321, 24; 366/19, 40, 64, 66, 67, 154, 155, 162, 181, 186, 218, 219, 26, 28, 343

[56] References Cited

U.S. PATENT DOCUMENTS

| | | | |
|---|---|---|---|
| 2,125,046 | 7/1938 | Crandell | 366/40 X |
| 3,526,525 | 9/1970 | Versoy et al. | 427/240 X |
| 3,632,371 | 1/1972 | Mikulka | 427/345 X |
| 3,924,562 | 12/1975 | Harris et al. | 118/320 |
| 3,942,772 | 3/1976 | Smith | 366/26 |
| 4,023,776 | 5/1977 | Greten | 366/162 X |

*Primary Examiner*—Morris Kaplan
*Attorney, Agent, or Firm*—Carl B. Fox, Jr.

[57] ABSTRACT

Method and apparatus for mixing particulate materials, such as sand, gravel, and cement to form a concrete mix, and for mixing water with the concrete mix to form concrete, and for applying the concrete to a structure such as a pipe, wherein a controlled amount of aggregate is placed on a moving belt and leveled to further control its amount, and then a controlled amount of cement is placed upon the leveled aggregate and leveled to further control its amount, and then the materials on the belt are mixed by spiked rollers dipping into the mixture, water being added to form the concrete, and the concrete being impelled against the object by being passed between high speed rollers.

19 Claims, 3 Drawing Figures

METHOD OF MIXING AND SPRAYING CONCRETE ONTO PIPE

This is a continuation of application Ser. No. 709,189, filed July 27, 1976, now abandoned.

BACKGROUND OF THE INVENTION

In the mixing of dry concrete mixes, and in the mixing of wet concrete, it has been difficult to achieve entirely satisfactory results with conventional methods and equipment. Conventional concrete mixing equipment uses a high energy input compared with the results achieved. Much of the wasted energy is the result of the high friction encountered between the housing and blades, and additional energy is wasted because the mixer operation involves repeated lifting and dropping of the materials being mixed. The equipment is subjected to a high rate of wear, and maintenance costs are usually high. Frequently, the materials are not thoroughly mixed so that the resulting concrete is of non-uniform composition and strength. Concrete mixing is usually a batch operation requiring a substantial amount of time, so that a number of separate mixers must be used if a steady flow of concrete mix or concrete is required. Attempts to mix concrete on a continuous basis have not been successful. Typical concrete mixing methods and apparatus are disclosed in U.S. Pat. Nos. 1,332,938, 2,264,170, 2,610,373, 3,107,901, and 3,306,589.

U.S. Pat. No. 3,942,772 discloses a concrete mixing apparatus and method wherein aggregate and cement are directed to free fall together onto a rotating spiked roller disposed across a traveling air-supported belt. Initial mixing occurs during the free fall of the materials, and mixing is completed at the initial spiked roller and at additional spiked rollers located along the belt. This method and apparatus works reasonably well, but certain difficulties have been encountered during operation. The biggest problem has been the buildup of cement and cement-aggregate mixtures on the interior of the housing for the equipment adjacent the spiked roller onto which the raw materials are fed, caused by the raw materials being thrown against the walls of the housing by rotation of the spiked roller. It is next to impossible to exclude all dampness from the apparatus resulting from atmospheric moisture, which causes the materials thrown against the walls to stick to the walls. Another problem has been the partial separation of the raw materials upon impact of the mixed materials falling onto the spiked roller and belt. The cement tends to separate and become concentrated along the sides of the belt, resulting in a higher concentration of aggregate at the center portions of the belt. This aggrevates the buildup and plugging problems, as the cement, being hydroscopic, becomes sticky and is difficult to mix completely back into the mixture. Mixing would be more satisfactory if the cement-aggregate proportions were constant across the full width of the belt.

SUMMARY OF THE INVENTION

According to the invention, methods are provided which are similar to the methods of U.S. Pat. No. 3,942,772, but which are modified to avoid the problems of that patent. According to the invention, the aggregate is first placed on the mixing belt and its amount is adjusted by passage of the aggregate beneath a scraper which levels the aggregate on the belt and sweeps off any excess. The cement is then delivered onto the aggregate layer and its amount is adjusted by passage beneath a scraper which levels the aggregate on the belt and sweeps off any excess. The amounts of aggregate and cement delivered onto the belt are controlled to a small excess of each, so that the scraping operations remove only small amounts of each material. The scrapers actions result in the disposition of a uniform layer of aggregate on the belt and a uniform layer of cement on the aggregate, so that the aggregate and cement will be mixed in continuously uniform proportions. Furthermore, the layers being uniform across the full width of the belt, the proportion of the aggregate and cement are uniformly constant across the full width of the belt.

The concrete, as in U.S. Pat. No. 3,942,772, is mixed by rotating spiked rollers, water being added in the last mixing stage or stages if desired. The concrete mix or concrete is of uniform composition and strength, and may be used for coating pipe or for any other purpose.

As should be apparent, the methods and apparatuses may be used to mix materials other than aggregate and cement. They may be used in substantially any situation where it is desired to mix materials in constant proportions. The process is not limited to the mixing of two materials, as three or four or even more layers may be disposed on a mixing belt according to the precepts of the invention and mixed. A liquid such as water may be added or not as desired.

A principal object of the invention is to provide an improved method for mixing particulate materials. Another object of the invention is to provides such methods wherein the materials are mixed in uniform proportions on a continuous basis. Still another object of the invention is to provide such methods wherein the amounts of the materials are controlled by passing the materials beneath separate scrapers in succession, so that a uniform layer of each material is obtained. A further object of the invention is to provide such methods wherein the problems of buildup and plugging are minimized.

Other objects and advantages of the invention will appear from the following detailed description of a preferred embodiment, reference being made to the accompanying drawings.

DESCRIPTION OF THE PREFERRED EMBODIMENTS

Figure 1:
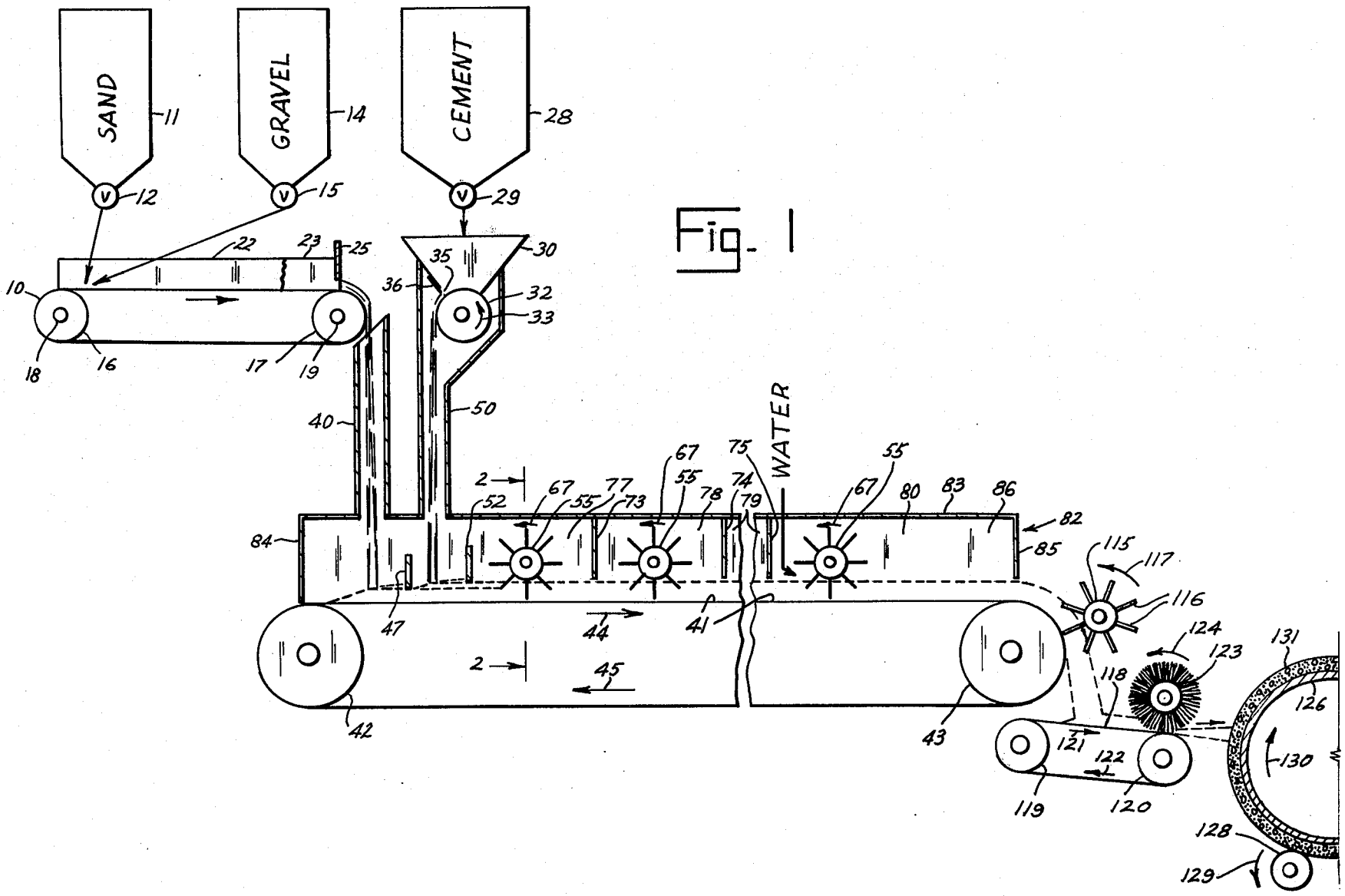
FIG. 1 is a schematic flow diagram showing a preferred embodiment of apparatus to practice the method of the invention.

Referring now to the drawings in detail, and first to FIG. 1, a conveyor 10 receives sand from hopper 11 controlled by outlet valve 12, and receives gravel from hopper 14 controlled by outlet valve 15. The proportions of sand and gravel are controlled by adjustment of valves 12 and 15. The sand and gravel may be supplied to conveyor 10 in any other suitable manner, the hoppers being shown as exemplary apparatuses. The gravel may be omitted for some types of concrete. Conveyor 10 is illustrated as a traveling belt conveyor supported by rollers 16, 17 having axles 18, 19, respectively. Any other form of flat bed conveyor may be substituted.

The apparatus may be used to mix materials different from the materials described in this description, as will be apparent to those skilled in the art.

Conveyor 10 is provided with walls 22, 23 at its opposite sides to retain the sand and gravel on the conveyor. An adjustable gate 25 may be raised and lowered to adjust the amount of material which may pass thereunder, thereby controlling the amount of material which the conveyor delivers. Valves 12, 15 are controlled so that only a small excess of the materials is delivered onto the belt, so that the gate 25 functions primarily as a leveler for the materials, at the same time controlling the output of the conveyor. The lower edge of the gate may have any suitable contour or shape, such as flat, scalloped, curved, sawtooth, or the like. Regardless of the shape of the lower edge of the gate, the materials conveyed on conveyor 10 are limited to a fixed yet adjustable area across the conveyor at gate 25 so that their amount is controlled.

Cement is delivered from hopper 28 through control valve 29 into hopper 30. A roller 32 having a roughened peripheral surface is fitted against the curved lower end of hopper 30, and is rotated in the direction of arrow 33 to drag cement from hopper 30 through opening 35 controlled by adjustable gate 36. The area through which the cement can pass is enlarged when gate 36 is raised, and reduced when gate 36 is lowered. The control realized at gate 36 is substantially the same as that realized at gate 25. The proportion of volume feed of aggregate and cement can be controlled by gates 25 and 36, as desired.

The aggregate from conveyor 10 falls through chute 40 onto a mixing belt 41. Belt 41 is supported by rollers 42, 43 at its ends, and is moved in the directions of arrows 44, 45, at least one of the rollers 42, 43 being driven by means not shown for that purpose. A scraper 47 is disposed spaced above belt 41, crossways of the belt, for leveling the aggregate on the belt across the full width of the belt, and for preventing passage of any excess of aggregate past the scraper. Gate 25 is adjusted so that the amount of aggregate piling up behind scraper 47 is small. Gate 25 might also be termed a scraper, and scraper 47 might also be termed a gate, as the two devices perform the same functions. Together, gate 25 and scraper 47 serve to control the amount of aggregate carried by belt 41 to the right of scraper 47.

Cement delivered by roller or drum 32 from hopper 30 falls through chute 50 onto the aggregate on belt conveyor 41 to the right of gate or scraper 47 as shown in FIG. 1. A second scraper or gate 52 is disposed across the belt 41 and spaced above the belt 41 to level the cement across the full width of the belt and to retain any excess amount of cement that will not pass thereunder. Again, the drum 33 rotation and the gate or door 36 are adjusted so that only a minimal excess of cement is delivered to belt 41. These elements and scraper 52 control the amount of cement which travels on the belt and aggregate to the right of scraper 52.

Thus, belt 41 carries, to the right of scraper 52 as shown in FIG. 1, a lower layer of aggregate and an upper layer of cement. Each of these materials is volumetrically controlled by the leveling scrapers 47 and 52, so that there is a constant proportion of aggregate and cement across the full width of belt 41.

The apparatus to the right hand side of scraper 52, FIG. 1, is as disclosed in U.S. Pat. No. 3,942,772. A series of mixing devices 55 are disposed along the belt in spaced relationships. Each device 55 consists of a roller or drum 56 (see also FIGS. 2–3) having a plurality of spikes or bars 57 spaced over their peripheral surfaces, the spikes or bars being disposed substantially radially as shown. The drums 56 are driven in rotation by one or more drive motors 60 each coupled to a gear box 61. Sheaves 62, 63 on the gear box and drum 56 shafts respectively are connected by a belt 64 passed around the sheaves. It is to be understood that this drive connection is exemplary only, and that other forms of drive connections may be used, such as a chain belt-chain sprocket connection or a gear connection. Suitable protective devices such as clutches may be included if desired.

The drum mixers 55 are driven in rotation in the directions shown by arrows 67, the bars at the lower sides of the drums moving past the belt 41 in the direction of belt travel. The aggregate and cement on the belt are dug through by the bars and thrown forward together as indicated at 68 in FIG. 3, this resulting in a very thorough mixing action on the materials. The first mixer 55, to the right of scraper 52, FIG. 1, breaks up the layers 70, 71 of cement and aggregate, respectively, and performs an initial mixing operation. The subsequent mixers 55 complete the mixing. Walls 73, 74, 75 may be provided as necessary and desired to provide separate mixing compartments 77–80. Any necessary or desired number of mixers 55 may be provided, as is indicated by the break shown between walls 74, 75. Usually, at least three of the mixers will be used. Rotation of the mixers in the direction opposite arrows 67 may be done, but rotation of the mixers in the direction of arrows 67 is preferred.

An enclosed housing 82 is provided to retain the materials inside the equipment, and to prevent dust pollution around the equipment, the housing including top 83, end walls 84, 85, and side walls 86, 87. For access to the interior of the housing, the upper and lower parts of the housing may be separated at flanges 88, 89, which are connected by suitable bolts or clamps, not shown, in conventional manner. Details such as the manner of connection of chutes 40, 50, and the supports for the various parts of the equipment, are not shown, since these are well within the skill of the art and may be accomplished in any desired suitable manner.

When it is desired to produce wet concrete, instead of a dry concrete mix of aggregate and cement, water may be introduced through conduit 92 leading from a suitable water supply at the final mixer 55 as shown. The final mixer wets the aggregate-cement mixture by stirring the water into it. Concretes of wet or relatively dry consistency may be produced, depending on the amount of water introduced. For coating pipes with concrete, relatively dry concrete mixtures are preferred.

Figure 2:
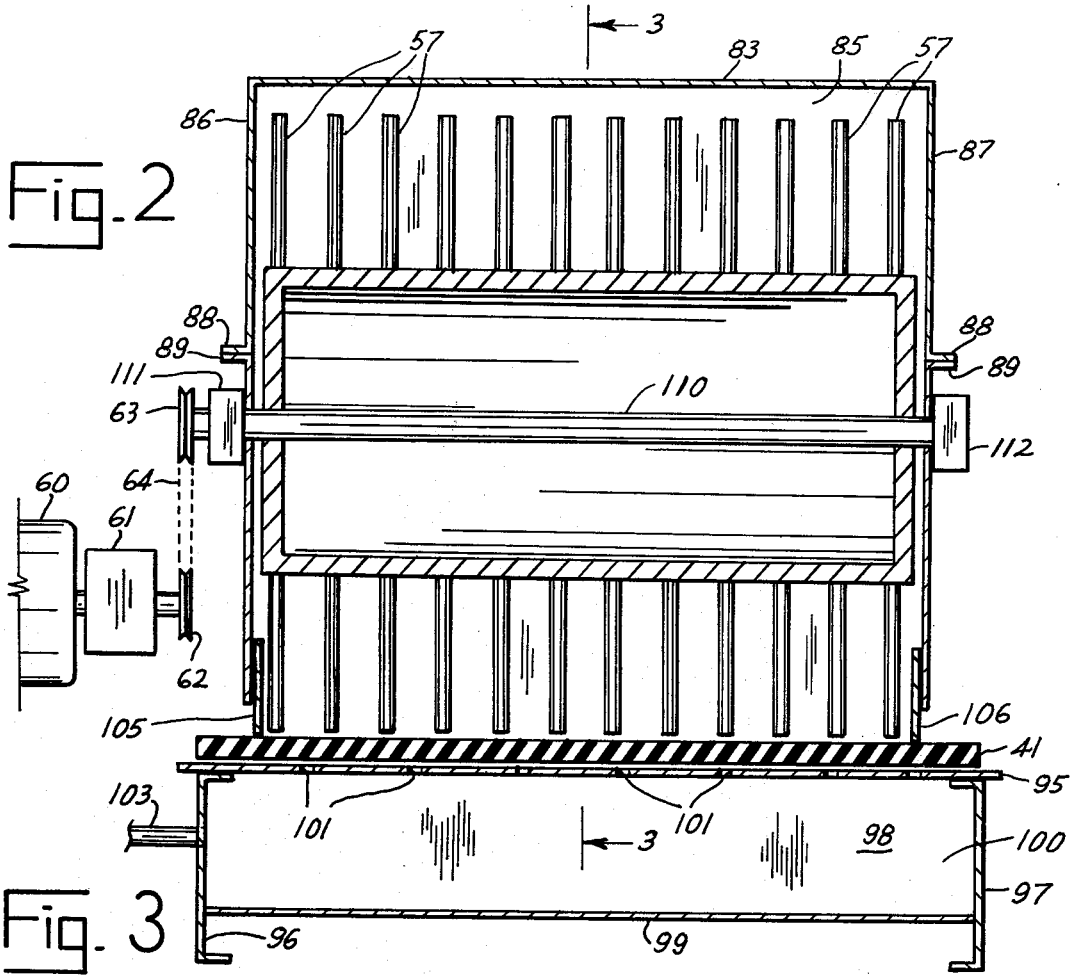
FIG. 2 is a vertical cross section taken at line 2—2 of FIG. 1.
Figure 3:
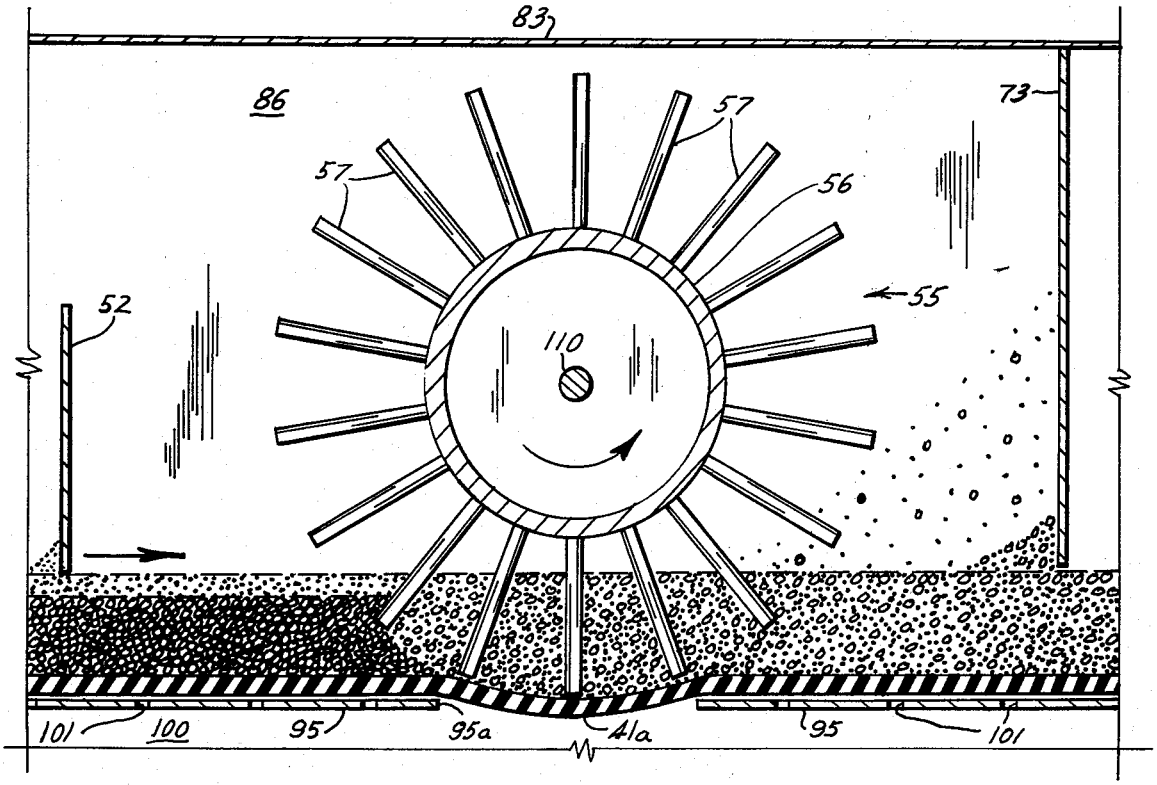
FIG. 3 is a vertical cross section taken at line 3—3 of FIG. 2.

Referring to FIGS. 2–3, the belt 41 is preferably supported on a layer of air above perforated plate 95. Plate 95 is supported above an air chamber formed by side channels 96, 97, opposite end plates 98, and bottom plate 99, welded together and to plate 95 to form an air chamber 100. Plate 95 has openings 101 distributed over its area beneath belt 41. Air under pressure is introduced through conduit 103 leading from a suitable source thereof, and the air passes through openings 101 to beneath the belt so that the belt is supported on a layer of air throughout its upper run. This reduces the belt friction with regard to plate 95 so that excessive energy is not required to drive the belt carrying a relatively heavy load of aggregate and cement in rotation.

Beneath each mixer 55, the plate 95 above which the belt 41, or conveyor, is supported on a layer of air may have an opening or gap 95*a*. The gaps in plate 95, if provided, are disposed crossways of the conveyor belt 41, beneath the rods 57 directed in a downward direction beneath the drum or roller 56.

In the event that the mixer rods should bear at their lower ends against a piece of gravel held against the belt, the belt may sag as at 41*a* to permit passage of the piece of gravel, to avoid unnecessary friction and wear of the belt. The mixer may be positioned as shown in FIG. 3, so that the rods 57 extend below the normal upper level of belt 41, or the mixer may be somewhat higher with regard to the belt position, as shown in FIG. 2, so that there is a slight clearance space between the lower ends of rods 57 and the upper surface of the belt.

In either event, the belt can sag as shown in FIG. 3 if material on the belt beneath the rod ends causes it to do so, without incurring damage to the belt.

The air beneath the belt 41 can exit from beneath the belt all around the edges of plate 95, including the edges of the gaps 95*a* beneath the mixers. Of course, sufficient air must be introduced to beneath the belt through holes 101 to maintain the belt slightly above plate 95, to reduce the drag on the belt and to reduce the power requirements for movement of the belt.

At the edges of the belt, seals are provided by strips 105, 106 which are adjustably connected to side walls 86, 87, respectively. Strips 105, 106 may be moved upwardly or downwardly so that they slidingly engage the belt at their lower edges to form a seal therewith. For example, bolts may be disposed through holes and/or slots in the walls and strips to provide the necessary adjustments, this structure not being shown in the drawings but being a common expedient, among others, for this type of adjustment.

Drums 56 of mixers 55 are supported for rotation by shafts 110 journaled in bearings 111, 112 at walls 86, 87, respectively. The sheaves 63, or a sprocket or gear, are carried at one end of each shaft 110.

The concrete mixed on belt 41 may be delivered beneath a cylindrical drum 115 having circularly spaced radial plates 116 affixed therearound. This drum is called a speed up drum or kicker cylinder, and is rotated in the direction indicated by arrow 117. Cylinder 115 delivers the concrete onto a high speed applicator belt 118 carried on rollers 119, 120, at least one of which is driven to move the belt in the directions indicated by arrows 121, 122. The concrete is moved to brush 123 mounted above belt 118 which is rotated at high speed as shown by arrow 124, which impels the concrete onto a pipe 126 supported by a plurality of support rollers 128, only one of which is shown in FIG. 1 and which rotates in the direction of arrow 129 to rotate pipe 126 in the direction of arrow 130. A layer or coating 131 of concrete is formed around the pipe 126. Preferably, a wire mesh is wrapped around pipe 126 prior to the application of the concrete coating to properly reinforce the concrete coating. The pipe 126 and the concrete discharge at brush 123 are relatively moved along the length of the pipe to form a concrete coating along the length of the pipe. In forming such a pipe coating, the concrete mixture is relatively dry so that the concrete will not sluff off of the pipe and will remain in place until set.

If wet or dry concrete mixes are prepared for purposes other than for pipe coating, the mixes may be delivered from the end of belt conveyor 41 in any suitable manner, onto another conveyor or into a receptacle or conveyance.

The methods and apparatus disclosed herein for mixing concrete, both dry mixes to which water is added later, and wet mixes with the water already added, are very efficient and economical. Power consumption is low, since there are no mixing blades causing high friction losses during mixing, and since the materials are not repeatedly lifted during mixing. Mixing is done on a continuous basis so that multiple mixing apparatuses are not required, and there is no delay while waiting for mixing to be completed. Serious plugging and buildup of materials in the equipment is not encountered, so that operation is smooth and troublefree. Concrete may be delivered to coat objects such as pipes and tanks on a continuous basis in a very efficient manner.

While preferred embodiments of methods have been described and shown in the drawings, many modifications thereof may be made by a person skilled in the art without departing from the spirit of the invention, and it is intended to protect by Letters Patent all forms of the invention falling within the scope of the following claims.

I claim:

1. Method for mixing particulate materials together to form a uniform mixture thereof, comprising continuously depositing a first layer of uniform thickness of a first material onto a moving conveyor provided with parallel walls at its opposite sides to retain material layers of uniform thicknesses thereon, continuously depositing at least one subsequent layer of uniform thickness of other material onto said first layer moving on said moving conveyor, each said layer of a material being separately leveled on said moving conveyor to control the volume of material in the layer for each unit length of said conveyor and to evenly distribute the layer of material to extend uniformly across said conveyor between said walls before depositing of another layer of other material thereon and before mixing of said layers, and continuously mixing said first and other material layers while said materials are moved by said moving conveyor to form a uniform mixture of said materials.

2. Method according to claim 1, wherein each material is dropped onto said conveyor and leveled by separately scraping the upper surface of the material to remove an excess thereof, said other material layers being scraped at their upper surfaces at successively higher levels above said moving conveyor.

3. Method according to claim 2, wherein each layer of material is leveled by moving the material on the conveyor beneath a separate scraper disposed parallelly spaced above the conveyor.

4. Method according to claim 3, wherein said layers are mixed on the conveyor by forcing plural spaced bars through said layers.

5. Method according to claim 4, including carrying said bars on a rotating device and rotating said device to force said bars through said layers.

6. Method according to claim 5, including mixing said layers with a series of said devices spaced along said conveyor.

7. Method according to claim 1, one of said first and other materials comprising aggregate and the other of said first and other materials comprising cement, said mixture comprising a concrete mix.

8. Method according to claim 7, including adding water to said mixture at one of said devices to form a wetted concrete mix.

9. Method according to claim 7, each said layer being separately leveled on said moving conveyor to control the volume of material in the layer for each unit length of said conveyor and to evenly distribute the layer of material to extend uniformly across said conveyor between said walls before depositing of the next layer thereon and before mixing of said layers.

10. Method according to claim 9, wherein said aggregate and cement are separately dropped onto said conveyor and leveled by separately scraping the upper surface of each layer to remove an excess of each material from said conveyor.

11. Method according to claim 10, wherein each layer is leveled by moving the material on the conveyor beneath a separate scraper disposed parallelly spaced above the conveyor.

12. Method according to claim 11, wherein said layers are mixed on the conveyor by forcing plural spaced bars through said layers.

13. Method according to claim 12, including carrying said bars on a rotating device and rotating said device to force said bars through said layers.

14. Method according to claim 13, including mixing said layers with a series of said devices spaced along said conveyor.

15. Method according to claim 14, including adding water to said mixture at one of said devices to form a wetted concrete mix.

16. Method according to claim 1, including preliminarily volumetrically controlling the volume of each of said first and other materials to be deposited on said conveyor to a volume somewhat in excess of the amount required to form each of said first and subsequent layers by conveying said materials through separate adjustable gates adapted to pass desired amounts of each of said first and other materials.

17. Method for coating pipe with concrete, comprising continuously forming a layer of aggregate of uniform thickness between parallel sidewalls along opposite sides of a moving belt conveyor, continuously forming a layer of cement of uniform thickness between said sidewalls upon said layer of aggregate, said layers each being of the same width and their thicknesses being controlled whereby the proportions of the volumes of aggregate and cement are uniform at all areas of said layers, moving said aggregate and cement layers on said belt conveyor successively past at least two mixers each comprising a rotating body having its axis transverse to said belt conveyor and having plural radial rods which rake though said aggregate and cement on said belt conveyor, mixing water into said mixture of aggregate and cement at one of said mixers after the first of said mixers to form a wet concrete mixture, discharging said wet concrete mixture from said belt conveyor by passing said concrete mixture to a rotating brush adapted to throw said concrete mixture onto the outer surface of a rotating pipe, and allowing said concrete mixture to set on said outer surface of said pipe.

18. Method according to claim 17, including delivering said concrete onto a high speed applicator belt conveyor above which said rotating brush is disposed.

19. Method according to claim 18, including impelling said concrete from said belt conveyor onto said high speed applicator belt by means of a rotating paddle wheel.

* * * * *